US009057573B1

(12) United States Patent
Cockerham et al.

(10) Patent No.: US 9,057,573 B1
(45) Date of Patent: Jun. 16, 2015

(54) PISTOL HAMMER

(71) Applicants: Bruce Eugene Cockerham, Brookings, OR (US); Robert Stanley Corkrean, Auburn, CA (US)

(72) Inventors: Bruce Eugene Cockerham, Brookings, OR (US); Robert Stanley Corkrean, Auburn, CA (US)

( * ) Notice: Subject to any disclaimer, the term of this patent is extended or adjusted under 35 U.S.C. 154(b) by 0 days.

(21) Appl. No.: 14/175,197

(22) Filed: Feb. 7, 2014

Related U.S. Application Data

(60) Provisional application No. 61/877,569, filed on Sep. 13, 2013.

(51) Int. Cl.
*F41A 19/14* (2006.01)
*F41C 3/00* (2006.01)

(52) U.S. Cl.
CPC .. *F41A 19/14* (2013.01); *F41C 3/00* (2013.01)

(58) Field of Classification Search
CPC ..... F41A 19/10; F41A 19/14; F41A 19/16; F41A 19/48
USPC ..... 42/69.03, 20, 41, 42.03, 43, 48, 69.01, 42/69.02; 89/147, 151, 27.14, 27.3
See application file for complete search history.

(56) References Cited

U.S. PATENT DOCUMENTS

| | | | | |
|---|---|---|---|---|
| 1,381,590 | A * | 6/1921 | Oliver | 89/147 |
| 3,109,345 | A * | 11/1963 | Norman | 89/144 |
| 3,726,040 | A * | 4/1973 | Cranston | 42/69.01 |
| 2006/0086030 | A1 * | 4/2006 | Moore | 42/69.03 |

* cited by examiner

*Primary Examiner* — Samir Abdosh
*Assistant Examiner* — John D Cooper
(74) *Attorney, Agent, or Firm* — Tod R. Nissle, P.C.

(57) ABSTRACT

A pistol hammer has a pistol cam formed around a hammer pin axis and configured to accommodate a strut. A pistol rear portion is immediately adjacent to the pistol cam. A pistol spur is immediately adjacent to the pistol rear portion. A pistol head is immediately adjacent to the pistol spur. The pistol head has a flat face that terminates at a flat face point. A concave front face is immediately adjacent to the pistol head extending in a smooth arc from the flat face point through an offset point to a termination point immediately adjacent to the pistol cam. The concave front face is configured to make contact toward a center of the firing pin retainer with a moment arm configured to fire the pistol with minimal force.

4 Claims, 4 Drawing Sheets

PISTOL HAMMER

RELATED APPLICATION

This application claims priority to provisional patent application U.S. Ser. No. 61/877,569 filed on Sep. 13, 2013, the entire contents of which is herein incorporated by reference.

BACKGROUND

The embodiments herein relate generally to firearm components.

Prior to embodiments of the disclosed invention, a hammer in a model 1911 pistol was formed as shown in FIG. 2B, FIG. 2D, FIG. 4, FIG. 6, and FIG. 8.

Firearm F comprises slide S which houses firing pin X and is mechanically coupled to rear sight R. Firing pin X is mechanically coupled to firing pin retainer E. Firing pin X travels along axis Sx rendering force Sf onto firing pin retainer E.

Hammer 1 comprised cam 2 formed around a hammer pin axis. Cam 2 is immediately adjacent to strut T. Cam 2 is further immediately adjacent to rear portion 3. Rear portion 3 is immediately adjacent to spur 4. Spur 4 is immediately adjacent to head 5. Head 5 is immediately adjacent to substantially flat front face 6.

Turning to FIG. 2B, substantially flat front face 6 causes an initial point of contact against firing pin retainer E to be a load force substantially distributed upon substantially flat front face 6 resulting in small moment arm 1M. Likewise, small moment arm 1M shrinks slightly as firing pin retainer E moves along axis Xa. The result is that is substantial initial force Sf is required to cock hammer 1.

This prior art includes U.S. Pat. No. 8,132,350 issued to Alves; U.S. Pat. No. 6,016,619 issued to Casull; and U.S. Pat. No. 6,460,282 issued to Bustos. Bustos and Casull are good examples of the prior art. Casull uses a substantially flat leading edge and Bustos uses a convex leading edge which have smaller moment arms and a smaller contact surface area than embodiments of the present invention. Alves is closer, using a concave leading edge, but Alves is configured for a Winchester model rifle that could accommodate a spring loaded firing pin with a point source. The present invention is concerned with a 1911 model pistol which cannot accommodate such a firing pin, as such the hammer described in Alves would be inoperable. Further, Alves offers no theory of increasing the moment arm on the firing pin as in the present invention.

SUMMARY

A pistol hammer is located within a firearm having a firing pin attached to a firing pin retainer and configured to fire a pistol with minimal force. The pistol hammer comprises a pistol cam formed around a hammer pin axis and configured to accommodate a strut. A pistol rear portion is immediately adjacent to the pistol cam. A pistol spur is immediately adjacent to the pistol rear portion. A pistol head is immediately adjacent to the pistol spur. The pistol head has a flat face that terminates at a flat face point. A concave front face is immediately adjacent to the pistol head extending in a smooth arc from the flat face point through an offset point to a termination point immediately adjacent to the pistol cam. The concave front face is configured to make contact toward a center of the firing pin retainer with a moment arm configured to fire the pistol with the minimal force.

In some embodiments, the flat face can be parallel and collinear to a first parallel axis. A point can be defined as being furthest on the smooth arc from the first parallel axis is on a second parallel axis that can be parallel to the first parallel axis. The first parallel axis can be offset from the second parallel axis by at least 0.050 inches. In some embodiments, the first parallel axis is offset from the second parallel axis by at least 0.073 inches.

In some embodiments a cam axis can intersect orthogonal to the hammer pin axis. A first perpendicular axis can be parallel to the cam axis while offset by a first distance and passing through the termination point. A second perpendicular axis can be parallel to the cam axis while offset by a second distance and passing through the offset point. A third perpendicular axis can be parallel to the cam axis while offset by a third distance and passing through the offset point. The third distance can be approximately twice the second distance.

In some embodiments, the first distance can be at least 0.250 inches. The second distance can be at least 0.50 inches. The third distance can be at least 0.63 inches. In some embodiments, the first distance can be about 0.318 inches. The second distance can be about 0.60 inches. The third distance can be about 0.730 inches. In some embodiments, the minimal force does not exceed 17 pounds force.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
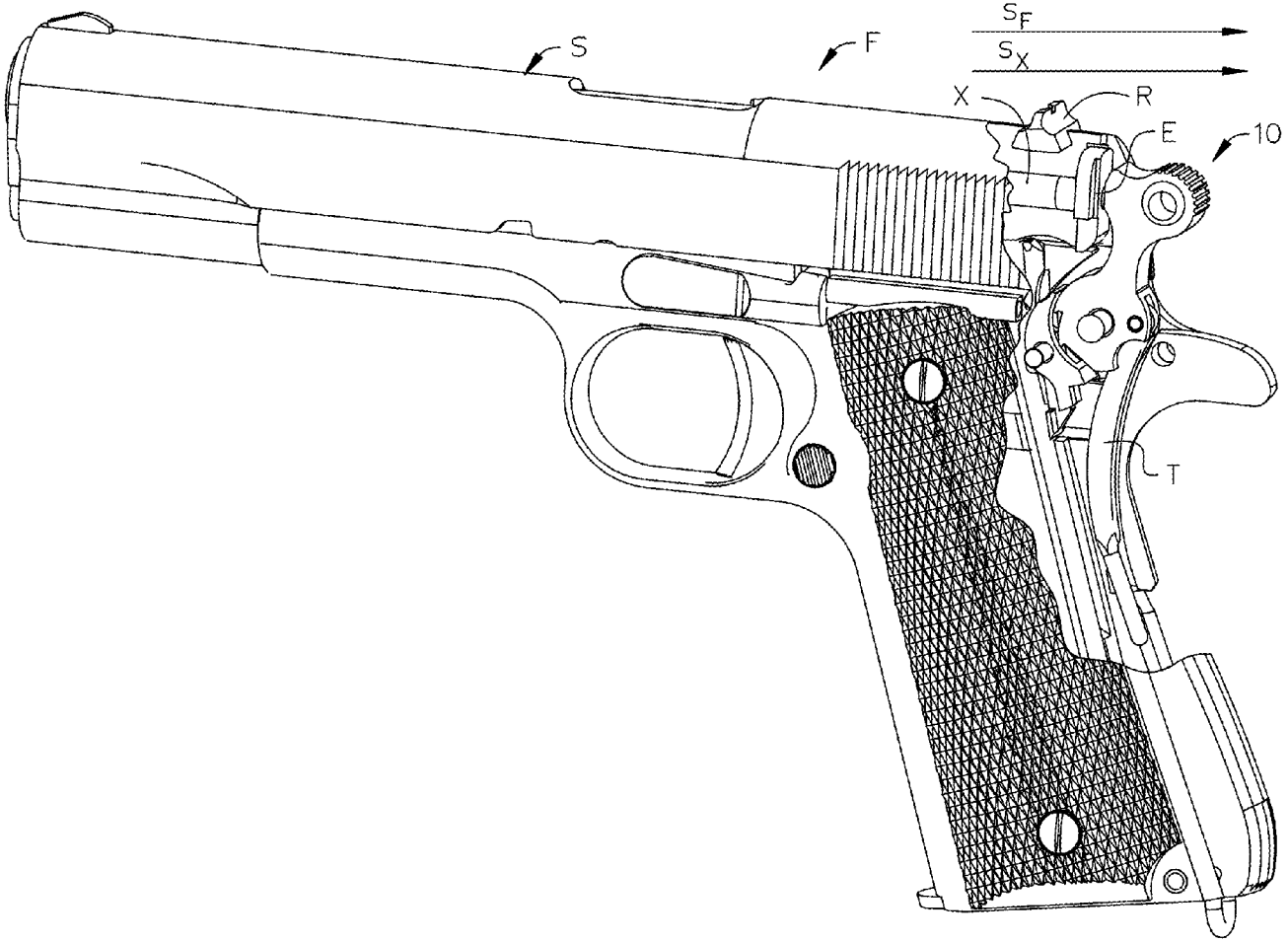
FIG. 1 shows a perspective view of one embodiment of the present invention.

By way of example, and referring to FIG. 1, one embodiment of the present system comprises pistol hammer 10 which is configured to be pulled from and then contact firing pin retainer E which moves firing pin X down slide S discharging a bullet.

Figure 3:
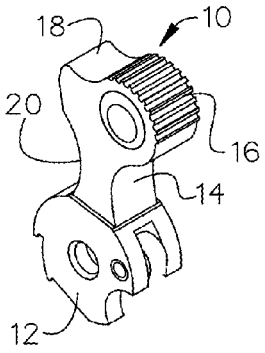
FIG. 3 is a rear perspective view one embodiment of the present invention.
Figure 4:
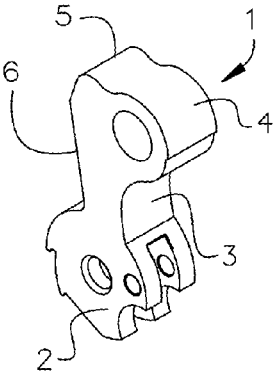
FIG.4 (PRIOR ART)
FIG. 4 is a rear perspective view of the prior art.
Figure 7:
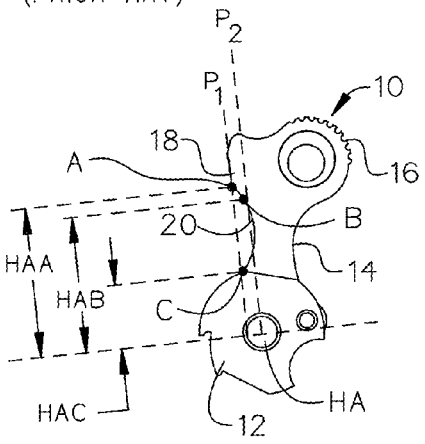
FIG. 7 is a side view of one embodiment of the present invention.
Figure 8:
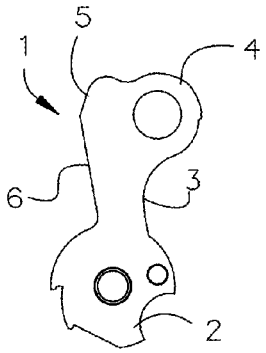
FIG.8 (PRIOR ART)
FIG. 8 is a side view of the prior art.
Figure 5:
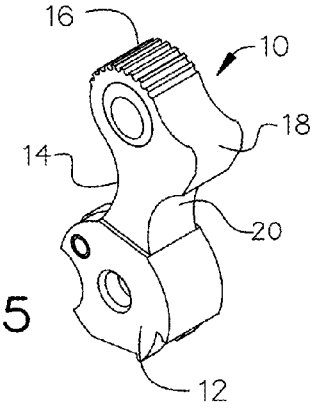
FIG. 5 is a front perspective view one embodiment of the present invention.
Figure 6:
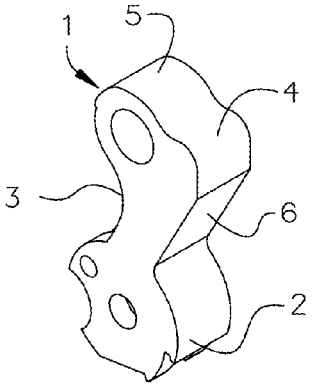
FIG.6 (PRIOR ART)
FIG. 6 is a front perspective view of the prior art.

Turning to FIG. 3, FIG. 5 and FIG. 7, pistol hammer 10 comprised pistol cam 12 formed around a hammer pin axis. Pistol cam 12 is immediately adjacent to strut T. Pistol cam 12 is further immediately adjacent to pistol rear portion 14. Pistol rear portion 14 is immediately adjacent to pistol spur 16. In some embodiments, pistol spur 16 further comprises a commander grip which makes it substantially easier to grip pistol spur 16. Pistol spur 16 is immediately adjacent to pistol head 18. Pistol head 18 is immediately adjacent to concave front face 20.

Pistol head 18 comprises a flat face that terminates at flat face point A. From there concave front face 20 proceeds inward in a smooth arc that passes offset point B. From there, the smooth arc continues to termination point C where the smooth arc terminates. Parallel axis P1 is parallel and collinear with front face 20 and extends downward to point C. The furthest point on the smooth arc from parallel axis P1 is intersects second parallel axis P2.

A horizontal axis passes through a central point in cam 12 forming cam axis Ha. Extending from cam axis Ha, a first perpendicular axis passing through point C is offset a first distance HAC. Extending from cam axis Ha, a second perpendicular axis passing through point B is offset a second distance HAB. Extending from cam axis Ha, a third perpendicular axis passing through point A is offset a third distance HAA.

While there are many ways to configure the smooth arc, it is desirable that firing pin retainer E not contact any lower on the smooth arc than point B. To accomplish that the following dimensions are exemplary: first parallel axis P1 and second parallel axis P2 are offset a distance of at least 0.050 inches and preferably at least 0.070 inches. First distance HAC is at least 0.250 inches and preferably 0.318 inches. Second distance HAB is at least 0.50 inches and preferable 0.60 inches. Third distance is at least 0.63 inches and preferably 0.730 inches.

Figure 2B:
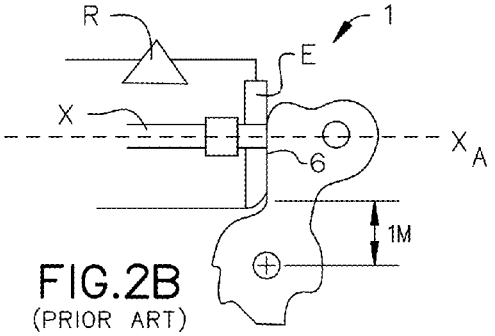
FIG.2B (PRIOR ART)
FIG. 2B shows a side view of the prior art.
Figure 2A:
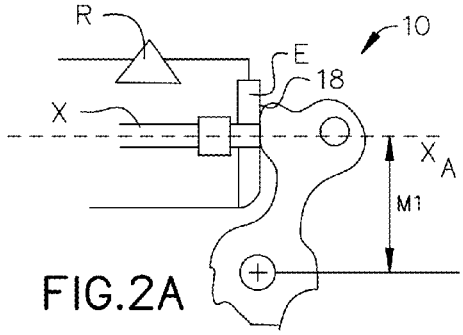
FIG. 2A shows a side view of one embodiment of the present invention.
Figure 2D:
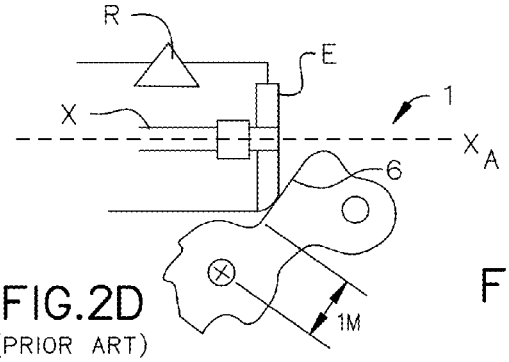
FIG.2D (PRIOR ART)
FIG. 2D shows a side view of the prior art.
Figure 2C:
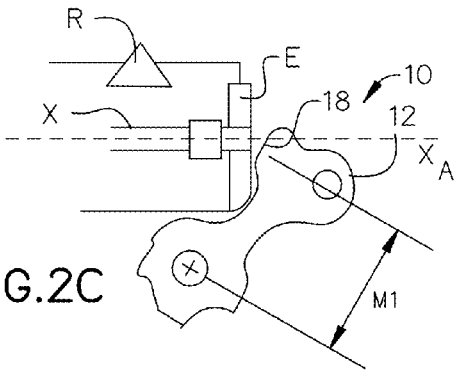
FIG. 2C shows a side view of one embodiment of the present invention.

When configured in this manner, and turning to FIG. 2A and FIG. 2C, moment arm M1 extends from the hammer pin center to a point which is at least point B, that is the minimum value of moment arm M1 is HAB, which is nearly twice as long as moment arm 1M being about HAC. This increase in moment arm M1 makes pistol hammer 10 much easier to maneuver than hammer 1 as shown in FIG. 9.

Figure 9:
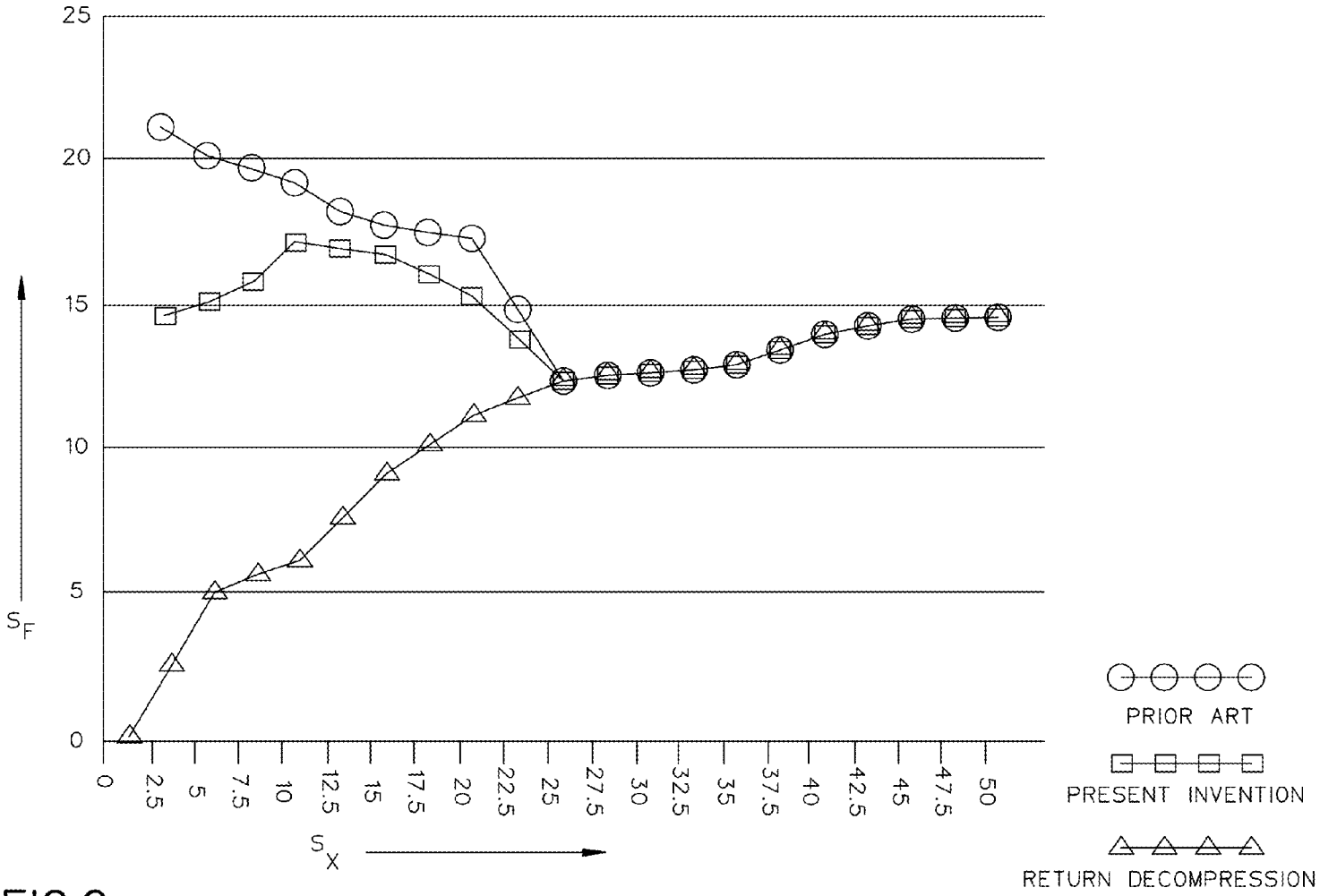
FIG. 9 is a chart showing test results of an embodiment of the present invention and the prior art.

Turning to FIG. 9, as slide S moves backward in millimeters on axis Sx, slide S render force Sf on hammer 1 (shown in circles) and pistol hammer 10 (shown in squares). For values ranging from 0 to 25 millimeters the force (in pounds force) rendered by the present invention is as much as 31% less than the prior art.

This difference is substantial to users suffering from arthritis and other conditions of the hand which require a lesser force in order to operate firearm F. This lesser amount of force needed to fire pistol P is called "minimal force" in this application. The minimal force does not exceed 17 pounds force.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A hammer-slide assembly located within a firearm and comprising (a) an elongate slide (S) including (i) an elongate central portion, (ii) an end having a center, an upper section extending upwardly from said center, and a lower section, said lower section having and terminating at a bottom and extending downwardly from said center to said bottom, (iii) a firing pin retainer (E) mounted on said end of said slide and including a central portion extending through said center of said end of said slide, an upper portion extending upwardly from said central portion over said upper section of said end of said slide and away from said end of said firing pin, and a lower portion, said lower portion having and terminating at a bottom and extending downwardly from said central portion over said lower section of said end of said slide and away from said end of said firing pin to said bottom of said lower portion, (iv) a firing pin (X) extending through said elongate central portion of said slide and including an end extending through said center of said end of said slide and said central portion of said firing pin retainer (E), and, (b) a pistol hammer including (i) a pistol cam (12) formed around a hammer pin axis, (ii) a pistol rear portion (14) immediately adjacent the pistol cam, (iii) a pistol head (18) connected to said pistol cam, wherein the pistol head (18) has a flat face that terminates at a lower flat face point (A), said flat face having a height, and (iv) a concave front face (20) immediately adjacent the pistol head (18) extending in a smooth arc from the lower flat face point through an offset point (B) to a termination point (C) immediately adjacent the pistol cam, said hammer-slide assembly having at least two operative positions, (c) a first operative position with (i) said bottom of each of said slide and said firing pin retainer terminating above said pistol cam, (ii) said flat face contacting along substantially the entire height of said flat face said central portion of said firing pin retainer and said end of said firing pin, (iii) said lower section and bottom of said slide entirely spaced apart from said front face (20) and said pistol cam (12), (iv) said lower section and bottom of said firing pin retainer entirely spaced apart from said front face (20) and said pistol cam (12), and (d) a second operative position with (i) said bottom of each of said slide and said firing pin retainer terminating above and displaced over said pistol cam, (ii) said slide displaced rearwardly a selected distance, (iii) said pistol hammer pivoted rearwardly about said hammer pin axis, (iv) said flat face canted and spaced away from said firing pin retainer along substantially the entire height of said flat face, (v) said lower section and bottom of said slide still entirely spaced apart from said front face (20) and said pistol cam (12), and (vi) said lower portion and bottom of said firing pin retainer still entirely spaced apart from said front face (20) and said pistol cam (12).

2. The hammer-slide assembly of claim 1 wherein (a) said pistol hammer includes a convex surface extending downwardly from said lower flat face point (A), and (b) when said slide and said pistol hammer move from said first operative position to said second operative position, said convex surface rolls over at least one in a group consisting of the end of said firing pin and said firing pin retainer.

3. A hammer-slide assembly located within a firearm and comprising (a) an elongate slide (S) including (i) an elongate central portion, (ii) an end having a center, an upper section extending upwardly from said center, and a lower section, said lower section having and terminating at a bottom and extending downwardly from said center to said bottom, (iii) a firing pin retainer (E) mounted on said end of said slide and including a central portion extending through said center of said end of said slide, an upper portion extending upwardly from said central portion over said upper section of said end of said slide and away from said end of said firing pin, and a lower portion, said lower portion having and terminating at a bottom and extending downwardly from said central portion over said lower section of said end of said slide and away from said end of said firing pin to said bottom of said lower portion, (iv) a firing pin (X) extending through said elongate central portion of said slide and including an end extending through said center of said end of said slide and said central portion of said firing pin retainer (E), and, (b) a pistol hammer including (i) a pistol cam (12) mounted to pivot about a hammer pin axis, (ii) a pistol head (18) connected to said pistol cam and having a hammer face that terminates at a lower face point (A), said hammer face having a height, (iii) a front face (20) beginning immediately adjacent said pistol head (18) and extending from the lower face point (A) to a termination point (C) immediately adjacent said pistol cam, said hammer-slide assembly having at least two operative positions, (c) a first operative position with (i) said bottom of each of said slide and said firing pin retainer terminating above said pistol cam, (ii) said hammer face contacting along substantially the entire height of said hammer face said central portion of said firing pin retainer and said end of said firing pin, (iii) said lower section and bottom of said slide entirely spaced apart from said front face (20) and said pistol cam (12), (iv) said lower section and bottom of said firing pin retainer entirely spaced apart from said front face (20) and said pistol cam (12), and (d) a second operative position with (i) said bottom of each of said slide and said firing pin retainer terminating above and displaced over said pistol cam, (ii) said slide displaced rearwardly a selected distance, (iii) said pistol hammer pivoted rearwardly about said hammer pin axis, (iv) said hammer face canted and spaced away from said firing pin retainer along substantially all of said height of said hammer face, (v) said lower section and bottom of said slide still entirely spaced apart from said front face (20) and said pistol cam (12), and (vi) said lower portion and bottom of said firing pin retainer still entirely spaced apart from said front face (20) and said pistol cam (12).

4. The hammer-slide assembly of claim 3 wherein (a) said pistol hammer includes a convex surface extending downwardly from said lower flat face point (A), and (b) when said slide and said pistol hammer move from said first operative position to said second operative position, said convex surface rolls over at least one in a group consisting of the end of said firing pin and said firing pin retainer.

* * * * *